US006860034B2

(12) United States Patent
Schmid

(10) Patent No.: US 6,860,034 B2
(45) Date of Patent: Mar. 1, 2005

(54) ENERGY RETURN SOLE FOR FOOTWEAR

(75) Inventor: Rainer K. Schmid, Eugene, OR (US)

(73) Assignee: Orthopedic Design, Eugene, OR (US)

( * ) Notice: Subject to any disclaimer, the term of this patent is extended or adjusted under 35 U.S.C. 154(b) by 0 days.

(21) Appl. No.: 09/827,933

(22) Filed: Apr. 9, 2001

(65) Prior Publication Data

US 2002/0144430 A1 Oct. 10, 2002

(51) Int. Cl.[7] ..... A43B 13/28
(52) U.S. Cl. ..... 36/27; 36/7.8; 36/35 R
(58) Field of Search ..... 36/27, 28, 38, 36/7.8, 35 R, 99, 71

(56) References Cited

U.S. PATENT DOCUMENTS

| | | | | | |
|---|---|---|---|---|---|
| 75,900 | A | * | 3/1868 | Hale et al. | 36/28 |
| 324,065 | A | * | 8/1885 | Andrews | 36/37 |
| 413,693 | A | | 10/1889 | Walker | |
| 493,663 | A | | 3/1893 | Steuart | |
| 1,144,188 | A | * | 6/1915 | Gerlach | 36/28 |
| 1,236,924 | A | | 8/1917 | Golden | |
| 1,516,359 | A | * | 11/1924 | Miceli | 137/577.5 |
| 1,516,395 | A | * | 11/1924 | Miceli | 36/7.8 |
| 2,228,149 | A | | 1/1941 | Maccarone | |
| 3,739,500 | A | * | 6/1973 | Cox | 36/114 |
| 3,822,490 | A | * | 7/1974 | Murawski | 36/105 |
| D247,074 | S | | 1/1978 | Henry | |
| 4,223,458 | A | | 9/1980 | Kihara | |
| 4,231,169 | A | | 11/1980 | Toyama et al. | |
| 4,279,415 | A | * | 7/1981 | Katz | 482/80 |
| 4,317,293 | A | | 3/1982 | Sigle et al. | |
| 4,457,084 | A | | 7/1984 | Horibata et al. | |
| 4,486,964 | A | | 12/1984 | Rudy | |
| 4,541,184 | A | | 9/1985 | Leighton | |
| 4,592,153 | A | * | 6/1986 | Jacinto | 36/38 |
| 4,597,196 | A | | 7/1986 | Brown | |
| 4,611,413 | A | | 9/1986 | Brown | |
| 4,628,621 | A | | 12/1986 | Brown | |
| 4,631,841 | A | | 12/1986 | Hickey | |
| 4,642,911 | A | | 2/1987 | Talarico, II | |
| 4,651,445 | A | | 3/1987 | Hannibal | |
| 4,858,338 | A | * | 8/1989 | Schmid | 36/44 |
| 4,910,884 | A | | 3/1990 | Lindh et al. | |
| 5,060,401 | A | | 10/1991 | Whatley | |
| 5,203,095 | A | * | 4/1993 | Allen | 36/27 |
| 5,282,325 | A | * | 2/1994 | Beyl | 36/27 |
| 5,337,492 | A | | 8/1994 | Anderié et al. | |
| 5,343,636 | A | * | 9/1994 | Sabol | 36/27 |
| 5,343,637 | A | | 9/1994 | Schindler | |
| 5,353,523 | A | * | 10/1994 | Kilgore et al. | 36/29 |
| 5,435,079 | A | * | 7/1995 | Gallegos | 36/27 |
| 5,678,327 | A | * | 10/1997 | Halberstadt | 36/27 |
| 6,029,374 | A | * | 2/2000 | Herr et al. | 36/151 |

FOREIGN PATENT DOCUMENTS

| | | |
|---|---|---|
| DE | 620963 | 10/1935 |

* cited by examiner

*Primary Examiner*—Jila M. Mohandesi
(74) *Attorney, Agent, or Firm*—Burns, Doane, Swecker & Mathis, LLP

(57) ABSTRACT

An article of footwear having an upper, an outsole defining a ground engaging surface, and a sole disposed between the upper and the outsole. The sole includes an energy return system having a first rigid plate, a second rigid plate spaced a predetermined distance from the first rigid plate, and at least one separating element disposed therebetween to maintain the spacing between the plates.

22 Claims, 6 Drawing Sheets

ENERGY RETURN SOLE FOR FOOTWEAR

BACKGROUND OF THE INVENTION

1. Field of the Invention

The present invention relates to an improved sole for footwear and more particularly to a sole which absorbs, stores and returns kinetic energy to a wearer of the footwear during the gait cycle.

2. Summary of the Related Art

Recently, considerable efforts have been devoted to develop improved running and other athletic shoes. Currently, there are many different types of running or athletic shoes which purport to provide cushioning from impact and comfort for all phases of activity. Shock absorption has been the primary focus of most of these research efforts. For example, U.S. Pat. No. 4,541,184 (Leighton) discloses an insole which is designed to provide shock absorption in the areas of the foot that are most subject to impact forces from ground contact.

Recent advances in biomechanics, however, indicate that cushioned running shoes may decrease the efficiency of the user. Experimenters have found that the arch of the foot acts like a spring, absorbing the energy of impact with the ground and giving it back with surprising efficiency to launch a runner forward again. Cushioned shoes, however, act to absorb the kinetic energy for the athlete. Up to 67% of the kinetic energy of a gait cycle may be absorbed and wasted by conventional athletic shoes.

The problem which must be addressed is not only how to minimize impact and provide comfort for the athlete's foot in running, jumping and other athletic endeavors, but also how to harvest and utilize energy resulting from certain phases of walking or running such as heel strike, midstance and toe off.

Some efforts have been devoted to develop devices which absorb and return a portion of the energy of the impact between a runner's foot and the ground. For example, U.S. Pat. No. 4,628,621 (Brown) discloses a rigid orthotic insert made of a plurality of layers of graphite fibers. The insert includes a mid-arch portion which is slightly raised relative to the rear portion and the forward portion of the insert. The insert however is disposed above the sole on the shoe. As discussed above, up to 67% of the gait cycle may be absorbed by cushioned soles. Therefore, most of the kinetic energy of the wearer is absorbed before reaching the orthotic insert.

U.S. Pat. No. 4,486,964 (Rudy) discloses a pair of moderators made of spring-type material which absorb and return kinetic energy. A first moderator is disposed in the heel area and absorbs high shock forces at heel strike. This moderator, which is shaped to cup and center the calcaneus at heel strike, elastically deforms and absorbs the energy at heel strike. As the athlete's gait cycle continues and the force on the moderator is reduced it returns the energy to the athlete. The second moderator disclosed by Rudy engages the forefoot of the athlete and has similar properties.

U.S. Pat. No. 5,353,523 (Kilgore et al.) has also addressed the issue of energy return. Kilgore et al. provide upper and lower plates which are separated by one or more foam columns. The foam columns, or support elements, are formed as hollow cylinders from a microcellular polyurethane elastomer whereas the upper and lower plates are formed from a semi-rigid material such as nylon, a polyester elastomer, or nylon having glass mixed therethrough.

Further, within the hollow areas of the support elements are gas pressurized bladders. Kilgore et al. relies upon the use of microcellular polyurethanes to restore the energy imparted during impact and upon the two element cushioning component to provide proper cushioning to the wearer.

The devices of Rudy, Brown and Kilgore et al. do not return the impact energy to the runner during the entire gait cycle due in part to the presence of the elastomeric material forming the midsole of the shoe wich absorbs the energy. The gait cycle typically consists of heel strike, midstance, a forward roll of the foot to the ball of the foot (toe break) and toe off. At the start of the gait cycle the initial part of the foot to engage the ground is the outward portion of the heel. This phase of the gait cycle is referred to as heel strike. Next the foot rolls to midstance and then rolls forward to the ball of the foot. In the final phase, referred to here as toe off, the toes propel the foot off the ground. The large toe provides the majority of the propelling thrust during this phase. It may provide up to 70% of the total thrust with the four small toes providing the balance.

Ground reaction forces and the line of progression of ground reaction forces on a runner's foot have been studied by Cavanagh et al., "Ground Reaction Forces in Distance Running", 13 J. Biomechanics 397 (1980). It would be advantageous to provide a device which utilizes the impact forces developed along the lines of progression of forces along the foot to optimally return the kinetic energy of the wearer's foot back to the wearer throughout the gait cycle.

Shoe mechanics studies also provide other desirable features which advantageously use the mechanics of the gait cycle. For instance Perry et al., "Rocker Shoe as Walking Aid in Multiple Sclerosis", 62 Arch Phys. Med. Rehabil. 59 (1981), demonstrates that clogs with a rocker bottom significantly facilitate ambulation of patients with certain neurologic deficits. The study suggests that a mean savings of 150% of normal energy was gained by multiple sclerosis patients which used a shoe having a rocker bottom sole.

Another factor which must be accounted for is the 25° external torsion of the foot and ankle relative to the knee axis in a gait cycle. That is, at toe off the foot twists outward, at an average angle of 25°, as the knee and hip extend forward.

It would be advantageous to provide a shoe which utilizes the rocker bottom principle along with the biomechanics of the gait cycle to improve the efficiency of an athlete. Such a shoe could harvest and utilize the energy resulting from certain phases of walking or running, store up the energy and return the energy to the athlete, thereby improving the efficiency of the athlete.

SUMMARY OF THE INVENTION

In view of the drawbacks of the prior art, it is a primary object of the present invention to provide a shoe sole for an article of footwear which will absorb and store the energy during all phases of the gait cycle and return the energy to the wearer.

It is a further object of the present invention to provide a shoe sole which achieves improved gait efficiency for an athlete.

It is still a further object of the present invention to provide a shoe sole which advantageously uses the biomechanics of the gait cycle to provide greater efficiency to the user.

To achieve the foregoing and other objects and in accordance with the purposes of the present invention, an article of footwear of the present invention includes an upper, an outsole defining a ground engaging surface, and a sole disposed between the upper and the outsole which includes an energy return system. The energy return system includes a first rigid plate, a second rigid plate spaced a predetermined distance from the first rigid plate, and at least one separating element disposed therebetween to maintain the spacing between the plates. The first and second plates preferably comprise a material having a modulus of elasticity of at least approximately $32\times10^6$ lb/in$^2$, such as carbon graphite. The at least one separating element preferably comprises an elastomeric material.

In accordance with one embodiment of the present invention, the first and second rigid plates extend substantially the entire length of the article of footwear and the at least one separating element comprises two separating elements, a first one disposed in a toe area of the article of footwear and a second one disposed in a heel area of the article of footwear. Still further, the first one of the separating elements may be generally arcuate.

In accordance with a further embodiment of the present invention, the first and second rigid plates extend only a portion of the length of the article of footwear, most preferably from the toe area to the arch area, and only one separating element is provided in the toe area thereof.

Still further, the present invention is directed to an energy return system for use in a shoe sole, the system comprising a first rigid plate, a second rigid plate spaced a predetermined distance from the first rigid plate, and at least one separating element maintaining the distance between the first and second rigid plates. The first and second plates comprise a material having a modulus of elasticity of at least approximately $32\times10^6$ lb/in$^2$, preferably carbon graphite, and maybe formed by a plurality of layers of carbon graphite. Each of the first and second rigid plates may extend substantially the entire length of a foot and is preferably configured to include a rocker bottom. Alternatively, each of the first and second rigid plates may extend only a portion of the length of a foot, preferably from a toe area of the foot to an arch area of the foot.

The energy return system of the present invention absorbs and stores energy as it is deflected at heel strike, midstance and toe off and returns the energy to the wearer during and just following these phases of the gait cycle. The rigid, high tensile material of the sole actively fights to resume to its pre-existing state, thereby propelling the wearer forward and upward as desired.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

Figure 1:
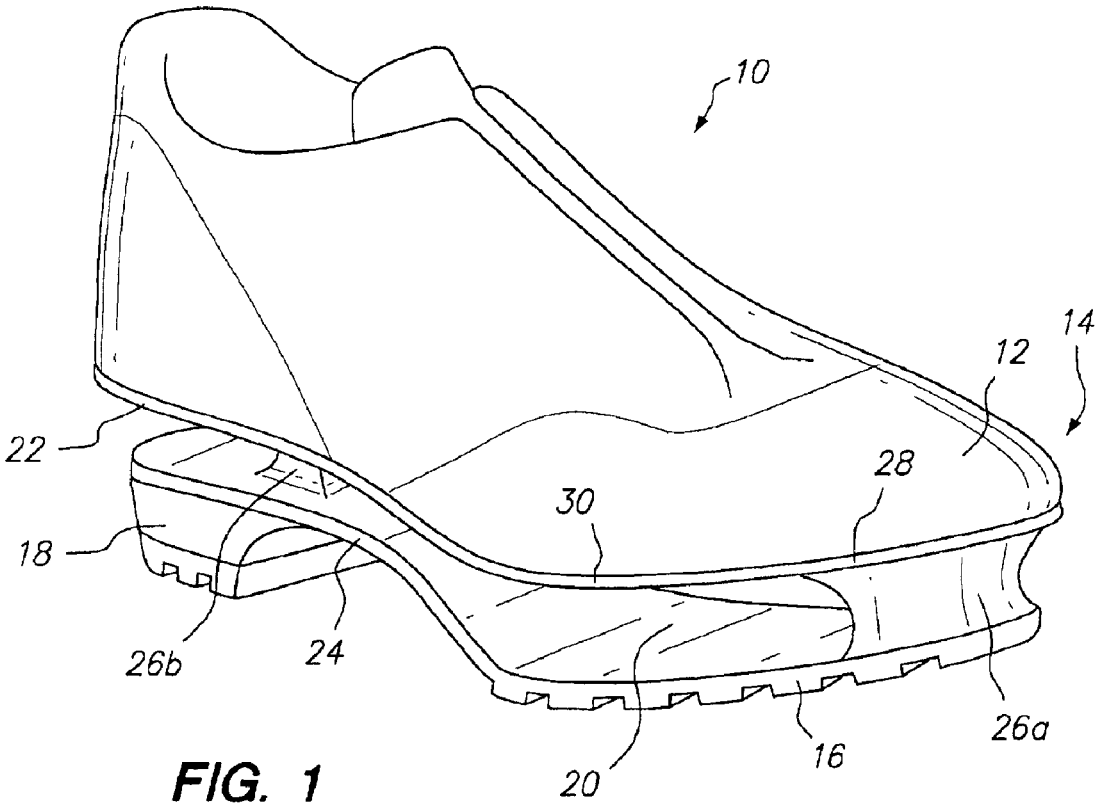
FIG. 1 is a perspective view of a shoe including the energy return system of the present invention.
Figure 2:
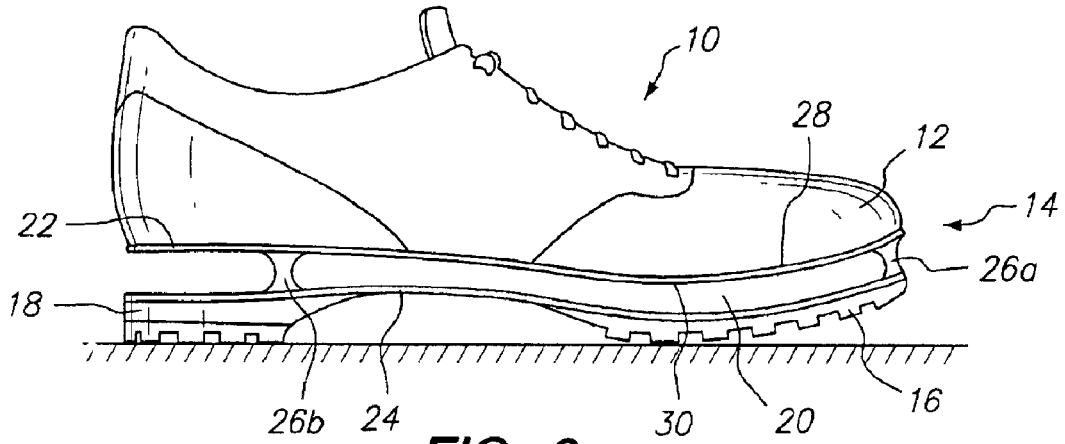
FIG. 2 is a lateral view thereof.
Figure 3:
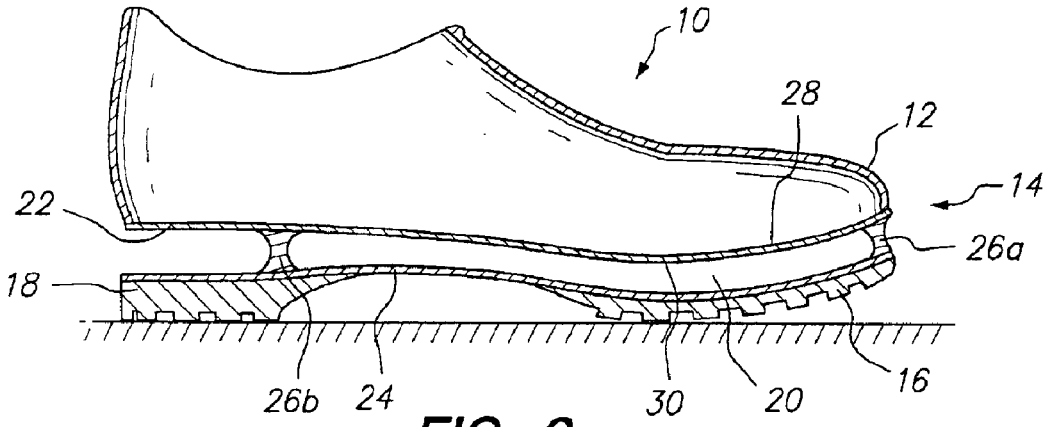
FIG. 3 is a cross-sectional view thereof.

Referring to FIGS. 1–3 a shoe 10, which is preferably an athletic shoe includes an upper portion 12 and a sole portion, designated generally by reference numeral 14. The sole portion 14 includes an outsole 16 and an energy return system 20, and may further include a heel 18 as shown in the illustrated embodiment. The energy return system 20 is defined by a proximal or upper sole plate 22, a distal or lower sole plate 24 and at least one separating element 26.

The outsole 16 defines the ground engaging surface and is preferably designed with conventional sole treads for providing traction to the wearer. The outsole is preferably formed from a conventional wear-resistant material, such as a carbon-black rubber compound. The heel 18, if provided, is preferably disposed immediately above the portion of the outsole 16 disposed on the posterior end of the shoe 10 and is formed preferably from a conventional cushioning material such as ethyl vinyl acetate (EVA) or polyurethane (PU) foam. The heel 18 is thus made of conventional shock absorbing material which acts to absorb the shock from ground force contact.

Figure 10:
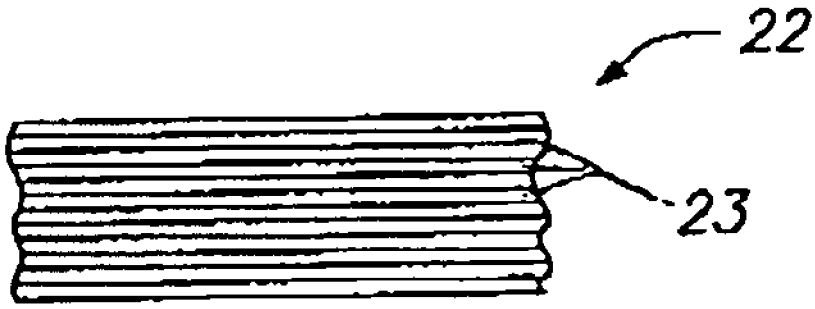
FIG. 10 illustrates an enlarged cross sectional view of a portion of one of the plates.

The energy return system 20 is preferably disposed between the outsole 16 and the upper portion 14 and, in the illustrated embodiment of FIG. 1, extends approximately the entire length of the shoe. The energy return system 20 includes upper and lower sole plates 22, 24 preferably made of an elastic material which is defined here as a rigid, high tensile strength material which has a modulus of elasticity of at least $32\times10^6$ lb/in.$^2$. Preferably, the material will also have a light weight property. A suitable material for the plates 22, 24 is a material made of carbon graphite fibers. Graphite has the advantages that it has high tensile strength, a high modulus of elasticity, is light weight, and as discussed below may be easily processed. The graphite plates 22, 24 may comprise a single layer of graphite fibers but preferably includes a plurality of layers 23, shown in FIG. 10. The upper and lower plates 22. 24 are formed generally in accordance with the teaching of U.S. Pat. No. 4,858,338 (Schmid), the entire contents of which are hereby incorporated by reference, wherein crossed fibers of a straight graphite strip and an angled graphite strip are used to cradle the first metatarsal head of the foot, provide maximum stiffness to resist torsion in both directions and activate the rocker bottom system, as discussed below. In the particular embodiment illustrated, however, a heel 18 having a greater height is provided. Further, in a preferred embodiment of the present invention, the graphite fibers will extend to the end of the shape of the plates 22, 24 and the fibers will be disposed in three different directions. There are preferably approximately twenty layers 23 of graphite fibers in the plates 22, 24 of the present invention, each layer providing increased shock absorption and energy release along the path of the gait cycle, as described In greater detail below.

The upper graphite plate 22 is formed such that a rocker bottom, indicated generally by reference numeral 28, cradles the first metatarsal head of the foot of the wearer. The width of the plate 22 is adapted to cover at least the width of the user's large toe and first metatarsal head, but may also cover the entire foot area as shown in FIG. 3. The roll point 30 of the rocker bottom 28 is preferably disposed approximately 2.5 cm. beyond the upper metatarsal heads, but may also be positioned between the toe break and approximately 2.5 cm.

behind the toe break of the wearer. Preferably, the roll point 30 is disposed approximately 60% forward from the posterior margin of the sole 14.

The energy return system 20 further includes at least one separating element 26 disposed between the upper and lower sole plates 22, 24. In the illustrated embodiment, a first separating element 26*a* is provided at the posterior end of the forefoot and a second separating element 26*b* is provided in the heel area of the sole portion 14. The separating elements 26 are preferably formed from a polyurethane elastomer. As will be appreciated by one skilled in the art, although any elastomer product could be adapted to provide the separating function and other mechanisms of separation and attachment could be used, the use of an adhesive for attachment is preferred so as not to cause a loss of fiber as would occur with riveting and polyurethane is preferred due to its ability to adhere to the carbon graphite fibers of the plates 22, 24. The separating elements 26 are provided primarily for the purpose of maintaining the desired spacing between the upper and lower plates 22, 24 so that independent movement of each of the plates can be obtained. Thus, since shock absorbency is not a specific goal thereof, other materials and even rigid or mechanical separator are also deemed to be within the scope of the present invention.

The shoe sole 14 of the present invention provides a means for advantageously using the lines of progression of forces from impact on the foot. The graphite plates are strategically spaced from each other and placed along the lines of progression of forces between the ground and the foot. The plates thus provide a source of rebound energy. The rocker bottom configuration of the graphite plates is utilized to enhance the efficiency of an athlete. The shoe sole of the present invention thus enhances the wearer's efficiency through the entire gait. The embodiment of FIGS. 1–3 discussed above is used below as an example of how the energy return system of the shoe sole functions throughout the gait cycle.

Figure 7A:
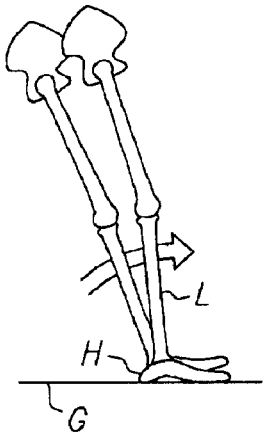
FIGS. 7A–7C schematically illustrate the gait cycle.
Figure 7B:
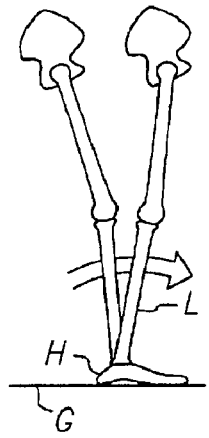
Figure 7C:
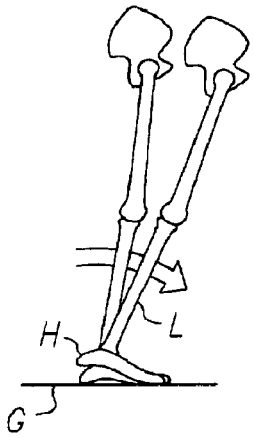

The gait cycle of normal human locomotion includes three main rocker positions, as schematically shown in FIGS. 7A–7C. The first of these position is defined by heel strike, when initial contact is made with the ground surface G by the heel H and thereby provides a heel rocker (FIG. 7A). After initial contact, the body weight of the person is transferred onto the forward limb L and using the heel H as a rocker, the knee is flexed for shock absorption. This stance is called a loading response. During the next phase of the gait cycle, the midstance, the limb L advances over the stationary foot due to ankle dorsiflexion, thereby providing an ankle rocker (FIG. 7B), and the knee and hip extend. Finally, during the terminal stance of the gait cycle, the heel H rises and the limb L advances over the forefoot rocker (FIG. 7C).

Figure 8A:
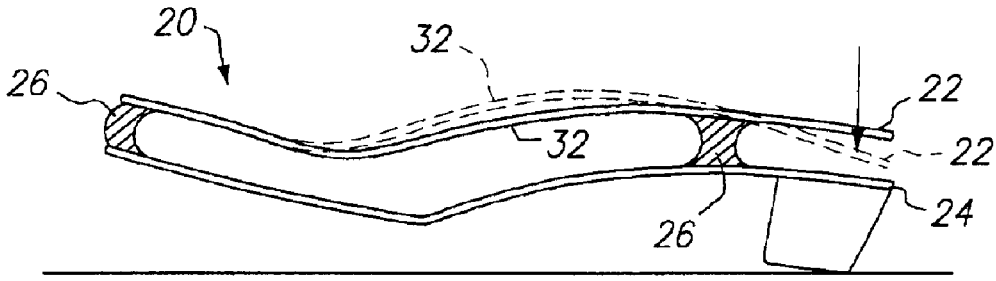
FIGS. 8A–8C schematically illustrate the energy return system of the present invention throughout the gait cycle.

Referring to FIG. 8A, at heel strike (heel rocker) the heel portion of the energy return system 20 flexes in all planes to accommodate heel contact of different people. More particularly, upper plate 22 is deflected downward toward the ground surface (as shown in broken lines), thereby causing the arch portion 32 to be deflected upwards, or preloaded, as shown in broken lines. The bottom plate 24 also assists in absorbing the shock from heel strike through the hydraulic action of the two heel portions of the plates 22, 24 acting through the elastomer separating element 26. That is, the bottom plate 24 at heel strike provides the opposing ground reaction force to the top plate so that by having two plates 22, 24 that deflect in synergy, shock absorption occurs at impact so as to dampen out vibrations encountered during running (or walking). At the heel rocker, the muscles on the front of the leg contract to decelerate the foot drop into a flat foot position. At this point, the leg is leaning backwards in the sagittal plane (see FIG. 7A). The deflected portion of the plates 22, 24, extending approximately from the separating element 26*b* rearward toward the heel, absorb the shock at impact and aid in the leg obtaining a ninety degree position over the heel, i.e., the loading response.

Figure 8B:
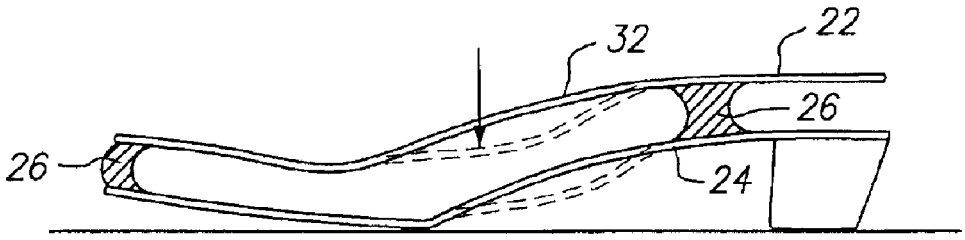

During the loading response, the separating elements 26 provide stability to the foot but also allow for the necessary medial and lateral motion to occur so that uneven terrain can be accommodated as in normal ankle motion. However, since this medial and lateral motion is controlled by the energy return system 20, less ankle motion is required in order to provide the same degree of stability. Just following heel strike, during midstance (ankle rocker), as shown in FIG. 8B, the energy return system 20 is slowly loaded as the limb advances over the stationary foot. The pressure under the metatarsals found during this stage of the cycle is significantly reduced because of the hydraulic action of the two plates under the metatarsals accommodating a significant portion of the pressure. At the ankle rocker point, the foot is flat on the ground and the arch is utilized to store energy. More particularly, energy can be stored approximately between the two separating elements 26*a*, 26*b* by the plates 22, 24 deflecting into an arch.

Figure 8C:
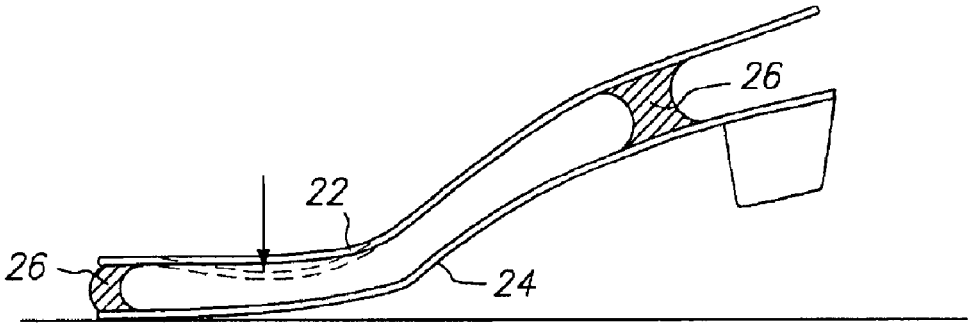

At toe off (forefoot rocker), as shown in FIG. 8C, the toe portion of the upper plate 22 is bent. The upper plate 22 accommodates the foot in slightly plantarflexed position while the lower plate 24 provides a rocker pivot point. The forefoot rocker is where the calf muscles act most vigorously. All the energy stored up to this point of the gait cycle is getting ready to be released into a step forward and upward. During use, the graphite fibers actively fight to resume their pre-existing state and both plates release the energy that had been stored from the arch and the ball of the foot area. Thus, not only does the energy return system 20 of the present invention rock the wearer forward, but it will also move in an upward motion thereby providing optimal energy return. Because the upward momentum is delivered primarily from the forefoot during toe off, the embodiment of the present invention shown in FIGS. 4–6, as discussed in detail below, is particularly useful for sprinters and jumpers, where the heel may never touch the ground.

Figure 9A:
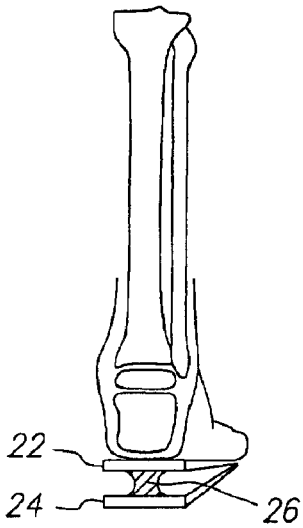
FIGS. 9A–9B schematically illustrate medial and lateral movements occurring during the gait cycle.
Figure 9B:
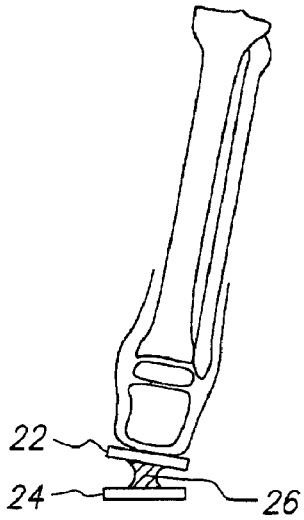

As discussed above, the majority of the force that is provided by the toes in running is provided by the large toe. The additional thrust provided by the small four toes during toe off, although not as large as that provided by the large toe, is still a significant factor in the gait cycle. The energy return system 20 accommodates the thrust provided by the small toes and the average 25° external torsion of the foot and ankle relative to the knee axis during a gait cycle. More specifically, as shown schematically in FIGS. 9A and 9B, the separating elements 26 of present invention are designed to accommodate various angles of the foot which may occur during the gait cycle. At heel strike, the hind foot is into supination (the ankle is turned in). The impact from the ground reaction forces are thus absorbed on the outside of the heel. The plates 22, 24 are still able to absorb the shock because the elastomeric nature of the separating elements allows the plates to deflect in that direction. In contrast, at the forefoot rocker, the forces are shifted from the lateral (outside) of the forefoot to the first metatarsal (big toe area). Due to the presence of the separating elements, the present invention allows the plates to also deflect in this direction and thus return the energy in the most optimal fashion throughout the gait cycle.

Figure 4:
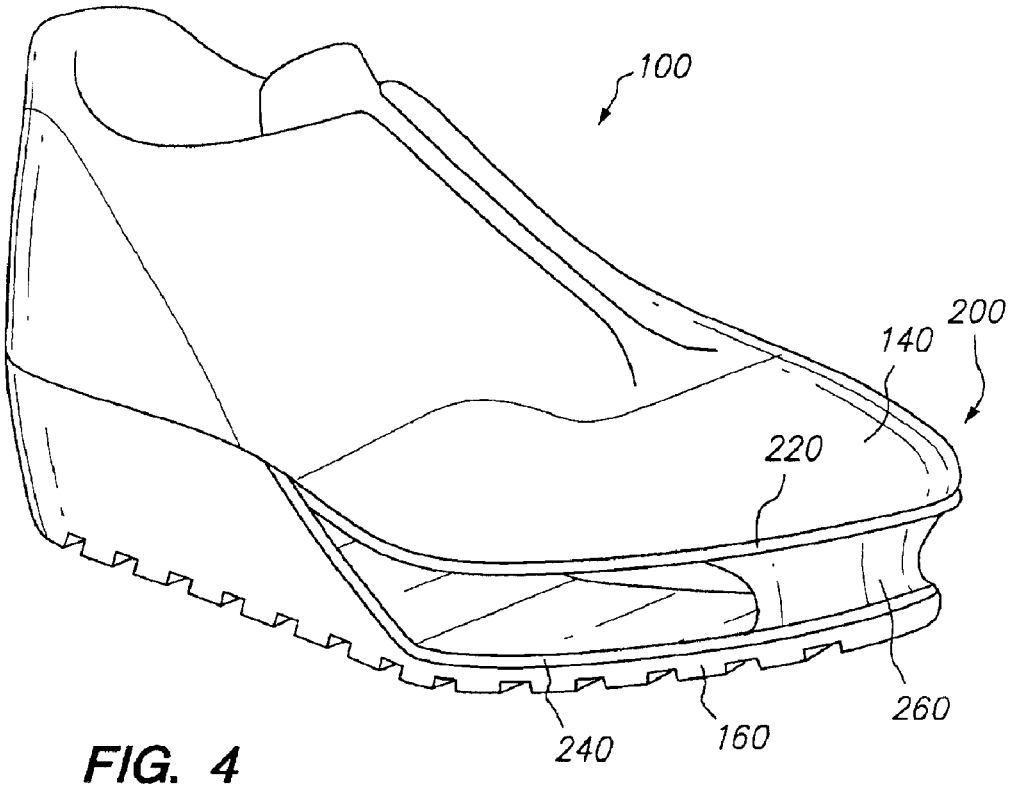
FIG. 4 is a perspective view of a shoe including a further embodiment of the energy return system of the present invention.
Figure 5:
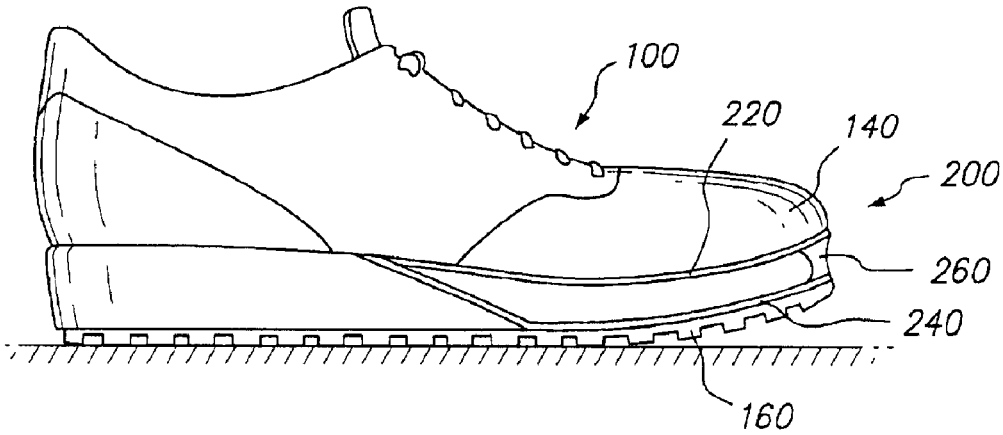
FIG. 5 is a lateral view thereof.
Figure 6:
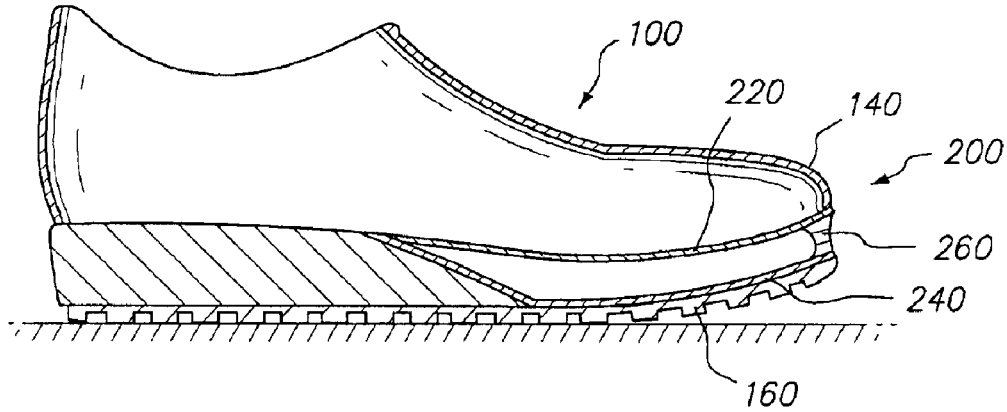
FIG. 6 is a cross-sectional view thereof.

Referring to the further embodiment shown in FIGS. 4–6, shoe 100 includes an energy return system 200 preferably disposed between the outsole 160 and the upper portion 140 and extends only a portion of the length of the shoe. As in the above-described embodiment of FIGS. 1–3, the energy return system 200 includes upper and lower sole plates 220, 240 preferably made of carbon graphite fibers. Most preferably, the upper and lower plates 220, 240 are also formed in accordance with the teaching of U.S. Pat. No. 4,858,338 (Schmid), wherein crossed fibers of a straight graphite strip and an angled graphite strip are used to cradle the first metatarsal head of the foot, provide maximum stiffness to resist torsion in both directions and activate the rocker bottom system, as discussed below. The energy return system 200 further includes at least one separating element 260 disposed between the upper and lower sole plates 220, 240. In the illustrated embodiment, the separating element 260 is provided in the toe area of the sole portion 140. The separating element 260 is preferably formed from a polyurethane elastomer, although other materials could also be used as discussed above. The separating element 260 is provided primarily for the purpose of maintaining the desired spacing between the upper and lower plates 220, 240 so that independent movement of each of the plates can be obtained.

Since the system of the present invention permits but dampens distortion and actively pursues return to the resting state, injuries such as ankle sprain, shin splints or other nagging problems may be minimized. The shoe sole system of the present invention not only accommodates but innovatively enhances the performance of athletes who use athletic footwear as an important component of their sporting endeavor.

Therefore, the present invention provides a shoe sole having an energy return system which may be particularly useful in athletic shoes. The shoe sole may be useful in activities such as walking, jogging, sprinting, aerobics, distance running, high jumping, poll vaulting, bicycling, and tennis. The number of graphite layers employed is selected to accommodate the weight and size of different users. Thus, the shoe sole may be used by persons of virtually all ages and body types.

Further, the energy return system of the present invention also has applications outside of footwear where it is desirable to relieve pressure from particular areas of the body which are subjected to continual contact or impact, such as, for example, the seat of a wheel chair, hospital beds, etc.

The foregoing description of the preferred embodiments of the present invention has been presented for purposes of illustration and description. It is neither intended to be exhaustive or to limit the invention to the precise forms disclosed. Obviously many modifications and variations are possible in light of the above-teachings. It is therefore intended that the scope of the invention be defined by the following claims, including all equivalents.

What is claimed is:

1. An article of footwear comprising:

an upper;

a sole having a ground engaging portion and an energy return system between the upper and the sole;

the energy return system comprising:

an upper plate and a lower plate spaced a predetermined distance from each other, the upper and lower plates having heel, arch, and toe portions, respectively, and made from an elastic material of high tensile strength, the plates independently deformable and recoverable from heel portion to toe portion; and two elastomeric elements, one disposed between the toe portion of the plates and the other disposed between the heel portion of the plates to maintain the spacing between said plates during a gait cycle of a wearer comprising a heel strike, a midstance, and a toe off;

during heel strike the heel portion of the upper plate deforms downward and the arch portion of the upper plate deforms upward;

during midstance the arch portion of both the upper and lower plates deforms downward and the heel portion of the upper plate recovers to a non-deformable state rocking the wearer forward; and during toe off the upper and lower plates recovers to the non-deformable state releasing stored energy into a step forward and upward propelling the wearer forward.

2. The article of footwear of claim 1, wherein the upper plate has a lateral side and a medial side, and wherein during heel strike the heel portion of the upper plate has greater deformation on the lateral side than the medial side.

3. The article of footwear of claim 2, wherein during midstance the arch portion of the upper plate has greater deformation on the lateral side than the medial side.

4. The article of footwear of claim 3, wherein during toe off the deformation of the toe portion of the upper plate shifts from the lateral side to the medial side.

5. The article of footwear of claim 1, wherein one of the two elastomeric elements is positioned at a posterior end of the upper and lower plates.

6. The article of footwear of claim 1, wherein said upper and lower plates comprise a material having a modulus of elasticity of at least approximately $32\times10^6$ lb/in$^2$.

7. The article of footwear of claim 6, wherein said material comprises carbon graphite.

8. The article of footwear of claim 7, wherein said upper plate and lower plates are formed by a plurality of layers of carbon graphite.

9. The article of footwear of claim 1, wherein said first one of said separating elements is generally arcuate.

10. The article of footwear of claim 1, wherein one of the separating elements is located entirely forward of a ball of a wearer's foot.

11. The article of footwear of claim 1, wherein the toe portion of the upper plate deflects downward before the upper and lower plates return to the non-deformable state.

12. An energy return system for use in a shoe sole comprising:

an upper plate and a lower plate spaced a predetermined distance from each other, the upper and lower plates having heel, arch, and toe portions, respectively and made from an elastic material of high tensile strength, the plates independently deformable and recoverable from heel portion to toe portion;

two elastomeric elements, one disposed between the toe portion of the plates and the other disposed between the heel portion of the plates to maintain the spacing between said plates during a gait cycle of a wearer comprising a heel strike, a midstance, and a toe off wherein;

during heel strike the heel portion of the upper plate deforms downward and the arch portion of the upper plate deforms upward;

during midstance the arch portion of both the upper and lower plates deforms downward and the heel portion of the upper plate recovers to a non-deformable state rocking the wearer forward; and during toe off the upper and lower plates deforms to the non-deformable state releasing stored energy into a step forward and upward propelling the wearer forward.

13. The article of footwear of claim 12, wherein the upper plate has a lateral side and a medial side, and wherein during heel strike the heel portion of the upper plate has greater deformation on a lateral side than a medial side.

14. The article of footwear of claim 13, wherein during midstance the arch portion of the upper plate has greater deformation on the lateral side than the medial side.

15. The article of footwear of claim 14, wherein during toe off the deformation of the toe portion of the upper plate shifts from the lateral side to the medial side.

16. The article of footwear of claim 12, wherein one of the two elastomeric elements is positioned at a posterior end of the upper and lower plates.

17. The energy return system of claim 12, wherein said upper and lower plates comprise a material having a modulus of elasticity of at least approximately 32×106 lb/in$^2$.

18. The energy return system of claim 17, wherein said material comprises carbon graphite.

19. The energy return system of claim 18, wherein said upper plate and lower plates are formed by a plurality of layers of carbon graphite.

20. The energy return system of claim 12, wherein said first one of said separating elements is generally arcuate.

21. The energy return system of claim 12, wherein one of the separating elements is located entirely forward of a ball of a wearer's foot.

22. The energy return system of claim 12, wherein the toe portion of the upper plate deflects downward before the upper and lower plates return to the non-deformable state.

* * * * *